US007481191B2

(12) United States Patent
Watanabe et al.

(10) Patent No.: US 7,481,191 B2
(45) Date of Patent: Jan. 27, 2009

(54) VARIABLE VALVE TIMING CONTROL APPARATUS OF INTERNAL COMBUSTION ENGINE

(75) Inventors: Masahiko Watanabe, Yokohama (JP); Atsushi Yamanaka, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 15 days.

(21) Appl. No.: 11/776,287

(22) Filed: Jul. 11, 2007

(65) Prior Publication Data

US 2008/0011255 A1 Jan. 17, 2008

(30) Foreign Application Priority Data

Jul. 12, 2006 (JP) ..... 2006-191179

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS 6,382,155 B2 * 5/2002 Simpson ..... 123/90.17

FOREIGN PATENT DOCUMENTS

JP 2004-239231 A 8/2004

* cited by examiner

*Primary Examiner*—Ching Chang
(74) *Attorney, Agent, or Firm*—Foley & Lardner LLP

(57) ABSTRACT

A variable valve timing control apparatus of an internal combustion engine, has a drive rotary member rotated by an engine crankshaft; a driven rotary member fixed to a camshaft that has a cam opening/closing an engine valve, the driven rotary member driven by the drive rotary member; a phase-change mechanism provided between the drive and driven rotary members and changing a relative rotational phase between the drive and driven rotary members; and a locking mechanism. The locking mechanism links any two of the drive rotary member, the driven rotary member and the phase-change mechanism or releases the link in accordance with temperature of the phase-change mechanism.

11 Claims, 10 Drawing Sheets

VARIABLE VALVE TIMING CONTROL APPARATUS OF INTERNAL COMBUSTION ENGINE

BACKGROUND OF THE INVENTION

The present invention relates to a variable valve timing control apparatus of an internal combustion engine, which variably controls open and closing timing of an intake valve and/or an exhaust valve of the engine via electromagnetic force.

In recent years, there have been proposed and developed various electromagnetic force type variable valve timing control apparatuses. One such variable valve timing control apparatus has been disclosed in Japanese Patent Provisional Publication No. 2004-239231 (hereinafter is referred to as "JP2004-239231").

The variable valve timing control apparatus disclosed in JP2004-239231 includes a timing sprocket to which a torque (turning force) is transferred from a crankshaft of an engine, a camshaft relatively rotatably supported within a predetermined angular range with respect to the timing sprocket, a sleeve fixedly connected to the camshaft, and a rotational phase control mechanism (or a relative angular phase control or shift mechanism) provided between the timing sprocket and the sleeve so as to control or shift a rotational phase of the camshaft relative to the timing sprocket in accordance with an engine operation condition.

The rotational phase control mechanism includes a radial direction guide window formed in the timing sprocket, a spiral guide (a spiral guide groove) formed on a surface of a spiral guide disk, a link member having two end portions: a base end acting as a pivot and a top end portion slidably supported in the radial direction guide window so that the top end portion can slide in a radial direction along the radial direction guide window, an engagement portion which is provided at the top end portion of the link member and whose top end (a spherical portion or a semi-spherical protrusion) is engaged with the spiral guide, and a hysteresis brake applying a braking force to the spiral guide disk according to the engine operating condition.

The hysteresis brake has at the front end side of the sleeve a coil yoke, and an electromagnetic coil circumferentially surrounded with the coil yoke. The coil yoke has at a rear side thereof a pair of circumferentially-opposed cylindrical surfaces with a cylindrical air gap left between the opposed surfaces. The coil yoke further has a plurality of pole teeth on the opposed surfaces respectively. Furthermore, a bottomed and cylindrical-shaped hysteresis member, which has a hysteresis characteristic of magnetic flux, is arranged in the air gap between the opposed surfaces (in the air gap between the opposed pole teeth). The hysteresis member is movable relative to the opposed pole teeth.

When the electromagnetic coil is energized, a magnetic field is induced between the opposed pole teeth across the hysteresis member, and then an electromagnetic brake acts on the spiral guide disk via the hysteresis member. By way of this action (braking on the spiral guide disk), the engagement portion is guided along the spiral guide while the engagement portion moves in the radial direction along the radial direction guide window. Thus, the sleeve (also the camshaft) can be rotated relative to the timing sprocket within a predetermined angular range.

Further, lubricating oil (lubricant) is constantly supplied and circulates in the rotational phase control mechanism. The cooling of the electromagnetic coil and good lubricity of each bearing are then ensured by this lubricating oil.

SUMMARY OF THE INVENTION

In the variable valve timing control apparatus, however, in a case where the engine stops for a long time in the cold season such as in winter, the viscosity of the oil in the rotational phase control mechanism becomes higher. In particular, high viscosity of the lubricating oil residing in spaces or gaps between the pole teeth causes an occurrence of braking torque at the engine start-up. Because of this, the braking torque acts on the spiral guide disk, and therefore the engagement portion slides in the spiral guide while radially moving in and along the radial direction guide window. Further, this turns the timing sprocket and the sleeve relatively, and there is a case where an improper action such as a shift of the rotational phase of the camshaft to an advanced phase will occur. In this case, there are risks that, for instance, not only deterioration of engine startability or instability of idling but also deterioration of exhaust emission performance will occur.

It is therefore an object of the present invention to provide a phase angle detection apparatus which is capable of preventing the improper action caused by viscous resistance of the lubricating oil.

According to one aspect of the present invention, a variable valve timing control apparatus of an internal combustion engine, comprises: a drive rotary member rotated by an engine crankshaft; a driven rotary member fixed to a camshaft that has a cam opening/closing an engine valve, the driven rotary member driven by the drive rotary member; a phase-change mechanism provided between the drive and driven rotary members and changing a relative rotational phase between the drive and driven rotary members; and a locking mechanism linking and releasing the link between any two of the drive rotary member, the driven rotary member and the phase-change mechanism in accordance with temperature of the phase-change mechanism.

According to another aspect of the present invention, a variable valve timing control apparatus of an internal combustion engine, comprises: a drive rotary member rotated by an engine crankshaft; a driven rotary member fixed to a camshaft that has a cam opening/closing an engine valve, the driven rotary member driven by the drive rotary member; a phase-change mechanism provided between the drive and driven rotary members and changing a relative rotational phase between the drive and driven rotary members; a locking mechanism linking and releasing the link between any two of the drive rotary member, the driven rotary member and the phase-change mechanism in accordance with temperature of the phase-change mechanism, and the locking mechanism has a lock pin establishing the link and releasing the link, a connecting hole into which the lock pin is inserted, and a movement adjustment part moving the lock pin in a direction in which the lock pin is inserted into the connecting hole when the temperature of the phase-change mechanism becomes substantially lower than or equal to a predetermined temperature and also moving the lock pin in a direction in which the lock pin is extracted from the connecting hole when the temperature of the phase-change mechanism becomes substantially higher than or equal to the predetermined temperature.

According to a further aspect of the invention, a variable valve timing control apparatus of an internal combustion engine, comprises: a drive rotary member rotated by an engine crankshaft; a driven rotary member fixed to a camshaft that has a cam opening/closing an engine valve, the driven rotary member driven by the drive rotary member; a phase-change mechanism provided between the drive and driven rotary members and changing a relative rotational phase between the drive and driven rotary members; and in a case where temperature of the phase-change mechanism is substantially lower than or equal to a predetermined temperature, any two of the drive rotary member, the driven rotary member and the phase-change mechanism are connected with each other and rotation of the camshaft relative to the engine crankshaft is restrained.

The other objects and features of this invention will become understood from the following description with reference to the accompanying drawings.

DETAILED DESCRIPTION OF THE INVENTION

Figure 1:
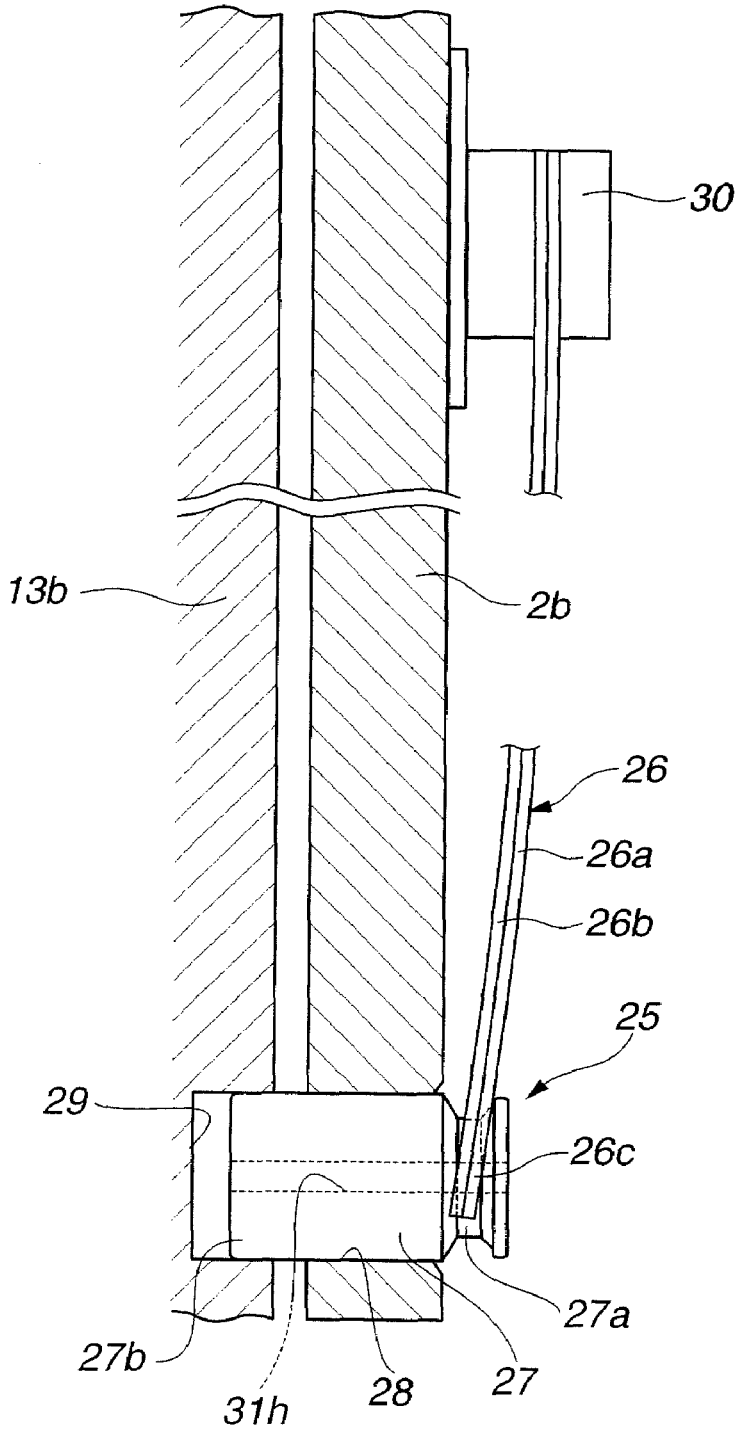
FIG. 1 is an enlarged sectional view of an essential part showing a first embodiment of the present invention.

Embodiments of a variable valve timing control apparatus of an internal combustion engine will be explained below with reference to the drawings. In the following description, the terms "front" and "rear" are used for purposes of locating one element relative to another and are not to be construed as limiting terms. And in FIGS. 4 and 5, "front side" is a side of a torsion spring 16 (described later), and "rear side" is a side of a cam 1*a* (also described later). Further, although each embodiment below is applied to control of open/close timing of an intake valve for the internal combustion engine, it can also be applied to control of open/close timing of an exhaust valve.

Firstly, the variable valve timing control apparatus will be explained with reference to FIGS. 3 to 7. The variable valve timing control apparatus includes a camshaft 1 rotatably supported on a cylinder head (not shown) of the engine, a timing sprocket 2 (as a drive rotary member or driving member) rotatably disposed at front side of the camshaft 1, and a relative angular phase control mechanism (simply, a phase converter or a phase-change mechanism) 3 disposed inside the timing sprocket 2 so as to change or control a relative rotational phase (or simply, a relative phase) between the camshaft 1 and timing sprocket 2.

The camshaft 1 has two cams 1*a*, 1*a* for each cylinder, which are disposed on an outer peripheral surface of the camshaft 1 to actuate respective intake valves, a driven rotary member (driven shaft member, or driven member) 4 connected with a front end of the camshaft 1 by a cam bolt 5 so that the driven rotary member 4 and the camshaft 1 are coaxially aligned with each other, and a sleeve 6 which screws on and is fixed to a front end portion of the driven rotary member 4.

The driven rotary member 4 has a cylindrical-shaped shaft portion 4*a* and a large-diameter stepped flange portion 4*b*. The shaft portion 4*a* is provided with a hole for receiving therethrough the cam bolt 5. And further, the shaft portion 4*a* is formed with a male screw thread on an outer peripheral surface thereof at a front end portion thereof in order for the sleeve 6 to screw on. The flange portion 4*b* is integrally formed with the shaft portion 4*a* at a rear end portion of the shaft portion 4*a* (in a position axially corresponding to the front end of the camshaft 1).

The sleeve 6 is formed with a female screw thread 6*a* on an inner peripheral surface thereof at a rear end portion thereof in order for the shaft portion 4*a* to be screwed in. Moreover, the sleeve 6 is caulked by an annular caulker so as to prevent the sleeve 6 turning after the sleeve 6 screws onto the shaft portion 4*a* fully and tightly and is fixed to the shaft portion 4*a*.

Regarding the timing sprocket 2, a plurality of sprocket teeth 2*a* are integrally formed with an outer circumference of the timing sprocket 2 in the circumferential direction. And then, the timing sprocket 2 with this ring-shaped sprocket teeth 2*a* is linked to an engine crankshaft (not shown) and turns via a timing chain (not shown). Further, the timing sprocket 2 has a plate member 2*b*, which is substantially disciform in shape, inside the sprocket teeth 2*a*. The plate member 2*b* is provided with a hole 2*c* at a center thereof for receiving therethrough the shaft portion 4*a* of the driven rotary member 4. The plate member 2*b* (the timing sprocket 2) is therefore rotatably supported by the outer peripheral 10 surface of the shaft portion 4*a* of the driven rotary member 4.

In addition, the plate member 2*b* is provided with two radial direction guide windows 7, 7 (as a radial guide) formed by parallel-opposed side walls respectively. More specifically, each of the radial direction guide windows 7, 7 is formed through the plate member 2*b* (that is, the radial direction guide windows 7, 7 penetrate the plate member 2*b*) such that each of the radial direction guide windows 7, 7 is arranged in a direction of a diameter of the timing sprocket 2. Further, two guide holes 2*d*, 2*d* are provided in the plate member 2*b* between the radial direction guide windows 7, 7 respectively (the two guide holes 2*d*, 2*d* also penetrate the plate member 2*b*). These radial direction guide window 7 and guide hole 2*d* are provided for receiving therethrough a top end portion 8*b* (described later) and a base end portion 8*a* (also described later) of a link member 8 (a follower portion, also described later), and therefore the top end portion 8*b* and the base end portion 8*a* can move or slide along the radial direction guide window 7 and the guide hole 2*d* respectively.

Each of the guide holes 2*d*, 2*d* is formed into arc-shape along a circumferential direction radially outside the hole 2*c*. And, a length in the circumferential direction of the guide hole 2*d* is set or dimensioned to a length corresponding to a movable range of the base end portion 8*a* (in other words, the length of the guide hole 2*d* is set to a length corresponding to a phase-shift range of relative rotational phase between the camshaft 1 and timing sprocket 2).

Each of the two link members 8, 8 (as a movable member) is formed into arc-shape, and has the above two end portions: the base end portion 8*a* and the top end portion 8*b*, at a front side of the flange portion 4*b* of the driven rotary member 4. The base end portion 8*a* and top end portion 8*b* are both formed into cylindrical-shape, and protrude toward the plate member 2*b* respectively. On the other hand, at a rear side of the flange portion 4*b* (at the side of camshaft 1), two lever protrusions 4*p*, 4*p*, which radially protrude, are formed. And further, a hole 4*h* is provided at each of the lever protrusion 4*p* through the lever protrusion 4*p* and the flange portion 4*b*. The base end portion 8*a* is, then, supported and rotatably or pivotally fixed to the driven rotary member 4 by pin 9. And, one end portion of pin 9 is press-fitted in the above hole 4*h*.

As mentioned above, the top end portion 8*b* of the link member 8 is slidably engaged in the radial direction guide window 7. The top end portion 8*b* is formed with a retaining hole 10 opening toward the front direction. And further, in this retaining hole 10, an engaging pin 11 (as an engaged portion) having a spherical-shaped end at front end thereof and a coil spring 12 biasing the engaging pin 11 toward the front direction (toward a spiral guide groove or spiral groove 15 (described later)) through the radial direction guide window 7, are provided. Spherical-shaped end of the engaging pin 11 is slidably engaged in the spiral guide groove 15 (described later) of a spiral guide disk 13 (or spiral disk, also described later), and therefore the top end portion 8*b* moves or slides radially in and along the radial direction guide window 7 while being guided along the spiral guide groove 15.

More specifically, the top end portion 8*b* is slidably engaged with the radial direction guide window 7, and the base end portion 8*a* is rotatably fixed to the driven rotary member 4 by the pin 9. With this setting or configuration, when the top end portion 8*b* moves or slides radially in and along the radial direction guide window 7 by an external force which results from the engaging pin 11 guided by the spiral guide groove 15, the base end portion 8*a* moves or slides in and along the guide hole 2*d*. The driven rotary member 4 consequently rotates relative to the timing sprocket 2 in a circumferential direction corresponding to a radial movement direction of the top end portion 8*b* by a certain degree corresponding to a displacement of the top end portion 8*b*. (That is, an operating angle of the driven rotary member 4 is shifted by the rotation of the spiral guide disk 13.)

Figure 3:
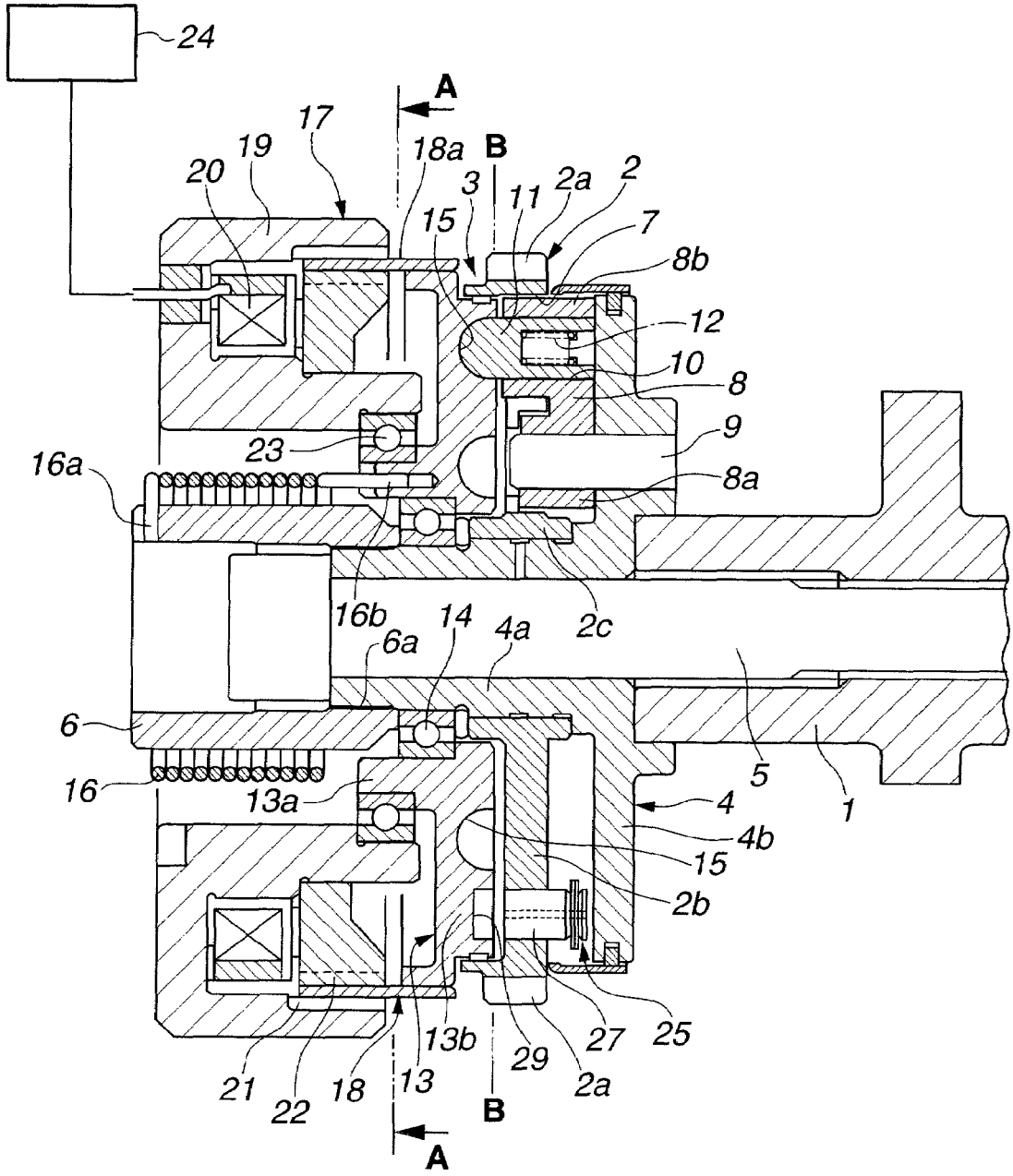
FIG. 3 is a longitudinal cross section of a variable valve timing control apparatus of an internal combustion engine, according to the first embodiment.

As for the spiral guide disk 13 facing to a front side of the plate member 2*b*, as illustrated in FIG. 3, the spiral guide disk 13 includes a cylindrical portion 13*a* having a ball bearing 14 and a disk portion 13*b* integrally formed with the cylindrical portion 13*a* at rear end of the cylindrical portion 13*a*. The spiral guide disk 13 is, then, rotatably supported on the shaft portion 4*a* of the driven rotary member 4 by means of the ball bearing 14. Each of the two spiral guide grooves 15, 15 is formed on a rear surface of the spiral guide disk 13 (that is, at the side of the camshaft 1). The spiral guide groove 15 serving as a spiral guide is semi-circular in cross section. A spherical-shaped end 11*a* of the engaging pin 11 of the link member 8 is slidably engaged with the spiral guide groove 15, and thereby being guided along the spiral guide groove 15.

Figure 7:
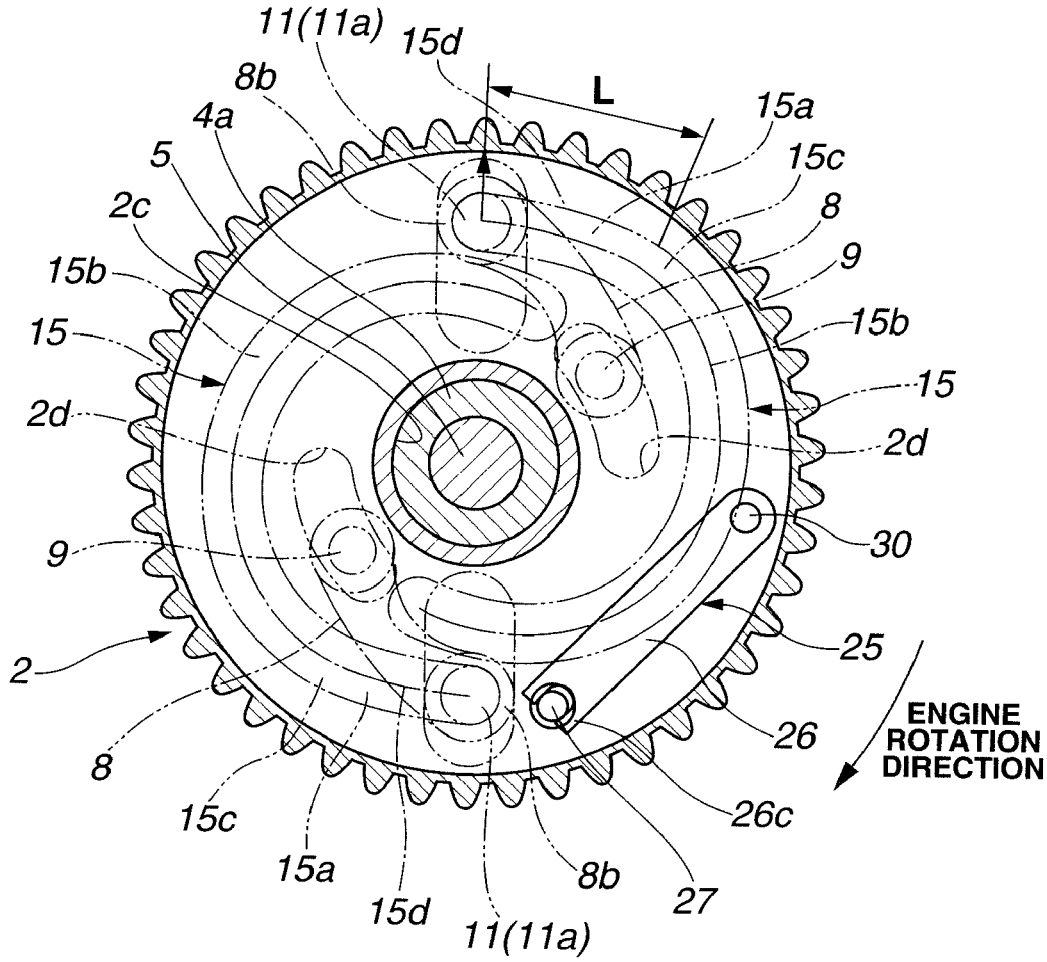
FIG. 7 is a sectional view of the variable valve timing control apparatus, when taken along a line B-B of FIG. 3, during the engine startup.

As can be seen from FIG. 7, each of the spiral guide grooves 15, 15 is arranged separately from each other. And further, each spiral guide groove 15 is formed such that its spiral radius gradually reduces along a direction of rotation of the timing sprocket 2. More specifically, an outermost groove section 15*a* (that is, a section from an inflexion point 15*c* up to the top end) located at the outermost portion of the spiral guide groove 15 is formed to be bent inwardly at the inflexion point 15*c* at a given angle. Furthermore, the outermost groove section 15*a* is slightly inwardly bent further by a small angle around a central portion of longitudinal length of the outermost groove section 15*a*.

That is to say, the spiral guide groove 15 has two sections: the outermost groove section 15*a* and a normal section 15*b* except outermost groove section 15*a*. A rate of change of spiral (rate of change of rotational phase) of the normal section 15*b* (or a convergence rate of the normal section 15*b*) is constant. In other words, the spiral radius of the normal section 15*b* gradually reduces along the direction of rotation of the timing sprocket 2. On the other hand, the convergence rate of the outermost groove section 15*a* is small as compared with that of the normal section 15*b*. That is, the outermost groove section 15*a* is formed in a substantially straight line along a tangent line of the spiral guide disk 13, and a length L of the outermost groove section 15*a* is set to be relatively long. Furthermore, with respect to the outermost groove section 15*a*, its top end portion from an almost central portion (a bending point 15*d*) of the length L is formed to be inwardly slightly bent further by a very small angle.

When the spiral guide disk 13 relatively rotates in a retarding direction with respect to the timing sprocket 2 with the engaging pin 11 being engaged with the spiral guide groove 15, the top end portion 8*b* of the link member 8 moves in a radially inward direction in and along the radial direction guide window 7 while being guided by the spiral guide groove 15. At this time, the camshaft 1 is rotated in an advancing direction. On the other hand, when the spiral guide disk 13 relatively rotates in an advancing direction with respect to the timing sprocket 2, the top end portion 8*b* moves in a radially outward direction. Here, when the engaging pin 11 (also the top end portion 8*b*) comes to the inflexion point 15*c* while being guided, the camshaft 1 is most retarded.

And further, when the spiral guide disk 13 is controlled to be rotated further, the engaging pin 11 (also the top end portion 8*b*) is guided and positioned at the outermost groove section 15*a*. At this time, a phase of the camshaft 1 is slightly shifted from the above most-retarded phase position to a slightly advanced phase position suitable for an engine starting (simply, an engine start-up phase).

The above-mentioned spiral guide disk 13 is provided with a relative operating turning force with respect to the camshaft 1 by way of a control force or operating force application mechanism (described later).

When provided with the operating turning force, the top end portion 8*b* of the link member 8 is radially displaced in and along the radial direction guide window 7 by the operating force via the spherical-shaped end 11*a* of the engaging pin 11 guided by the spiral guide groove 15. At this time, by way of motion-conversion mechanism or working of the link member 8, the driven rotary member 4 is displaced in the direction of rotation thereof or is relatively rotated with respect to the timing sprocket 2 by the turning force. That is, the link member 8 slidably engaged in the radial direction guide window 7 and the spiral guide groove 15 serves to convert the radial displacement of the top end portion 8*b* along the radial direction guide window 7 into the circumferential displacement of the base end portion 8*a* along the guide hole 2*d*. In other words, the link member 8 rockably linked to both of the radial direction guide window 7 and the spiral guide groove 15 acts as a motion converter, and therefore the driven rotary member 4 is rotated.

As illustrated in FIG. 3, the operating force application mechanism includes a torsion spring 16 (as a biasing device, as a means for forcing) permanently forcing the spiral guide disk 13 in the direction of rotation of the timing sprocket 2 via the sleeve 6, a hysteresis brake 17 (an electromagnetic brake)

that selectively generates a braking force against a force of the torsion spring 16 to force the spiral guide disk 13 in the reverse direction to the rotation of the timing sprocket 2, and an controller 24 (ECU: electrical control unit, output section) that controls the braking force of the hysteresis brake 17 according to the engine operating condition. By way of controlling the braking force of the hysteresis brake 17 appropriately by the controller 24 in accordance with the engine operating condition, the spiral guide disk 13 is relatively rotated with respect to the timing sprocket 2, or these rotational positions are held or maintained.

As can be seen from FIG. 3, the torsion spring 16 is disposed outside the sleeve 6. And a first end portion 16*a* of the torsion spring 16 is radially inserted into a hole formed at a front end portion of the sleeve 6 and is fixed to the sleeve 6. On the other hand, a second end portion 16*b* of the torsion spring 16 is inserted into a hole formed at a front side of the cylindrical portion 13*a* in an axial direction and is fixed to the cylindrical portion 13*a*. The torsion spring 16 serves to force and turn the spiral guide disk 13 in a direction of a starting rotational phase after the engine has stopped.

With respect to the hysteresis brake 17, the hysteresis brake 17 includes a hysteresis ring 18 integrally connected and fixed to a front outer periphery of the spiral guide disk 13, an annular coil yoke 19 arranged at a front side of the hysteresis ring 18, and an electromagnetic coil 20 circumferentially surrounded with the coil yoke 19 to induce magnetic flux in the coil yoke 19. The controller 24 precisely controls an application of current to the electromagnetic coil 20 according to the engine operating condition, a relatively large magnetic flux is therefore generated.

The hysteresis ring 18 is made of a magnetically semi-hardened material (i.e. a hysteresis material) having a characteristic showing a change of magnetic flux with phase lag behind a change of external magnetic field.

The coil yoke 19 is formed into a substantially cylindrical such that the coil yoke 19 circumferentially surrounds the electromagnetic coil 20. Further, the coil yoke 19 is held unrotatably by an engine cover (not shown) through a rattle or lash-absorption mechanism (or a lash eliminator). And also, the coil yoke 19 is supported on the cylindrical portion 13*a* of the spiral guide disk 13 via a ball bearing 23 provided at a cylindrical inner surface of the coil yoke 19 such that the spiral guide disk 13 rotates relative to the coil yoke 19.

As will be explained in detail about the pole teeth 21, 22, as can be seen from FIGS. 4 to 6, the coil yoke 19 includes a ring yoke portion 19*a* in an interior space portion thereof at a rear side thereof (at a side of the spiral guide disk 13), and a plurality of the opposed pole teeth 21, 22 arranged circumferentially at regular intervals on inner peripheral surface of the interior space portion of the coil yoke 19 and outer peripheral surface of the ring yoke portion 19*a*. More specifically, as shown in FIG. 6, each of the pole teeth 21, 22 formed in projected shape and serving to generate magnetic field (as a magnetic field generating portion) is arranged circumferentially in a staggered configuration. That is, each recessed portion between each tooth of the pole teeth 21, 22 and each projected portion of the pole teeth 21, 22 is placed on opposite sides of the circumferential air gap. Thus, upon energization of the electromagnetic coil 20, magnetic field is generated between the opposed adjacent projected portions. That is, the magnetic field is generated at a certain angle relative to a circumferential direction of the hysteresis ring 18. As described above, the top end portion 18*a* of the hysteresis ring 18 is located in the cylindrical air gap between the circumferentially-opposed pole teeth 21, 22 with the top end portion 18*a* in the non-contact with the pole teeth 21, 22. More specifically, an air gap between an outer peripheral surface of the top end portion 18*a* and the pole teeth 21, and an air gap between an inner peripheral surface of the top end portion 18*a* and the pole teeth 22 are set to infinitesimally small distances respectively to obtain a large magnetic force.

When the electromagnetic coil 20 induces magnetic flux in the coil yoke 19 and the hysteresis ring 18 rotates and is displaced in the magnetic field between the opposed pole teeth 21, 22, the braking force is generated due to a difference between a direction of magnetic flux in the hysteresis ring 18 and a direction of the magnetic field. As a result, the hysteresis brake 17 acts to brake the hysteresis ring 18 or to stop the rotation of the hysteresis ring 18. A strength of the braking force is independent of a rotational speed of the hysteresis ring 18 (i.e. a relative speed between the hysteresis ring 18 and opposed pole teeth 21, 22), but is substantially proportional to an intensity of the magnetic field (i.e. an amount of magnetizing current supplied to the electromagnetic coil 20). That is, if the amount of magnetizing current supplied to the electromagnetic coil 20 is constant, the strength of the braking force is also constant.

The controller 24 detects a current engine operating condition based on input information from a crank angle sensor detecting engine speed (engine rpm), an airflow meter detecting an engine load from an intake-air quantity, a throttle valve opening sensor, an engine temperature sensor and others (these are not shown), and then outputs a signal of control current supplied to the electromagnetic coil 20 according to the engine operating condition.

The relative angular phase control mechanism 3 has the radial direction guide window 7 of the timing sprocket 2, the link member 8, the engaging pin 11, the lever protrusion 4*p*, the spiral guide disk 13, the spiral guide groove 15, the operating force application mechanism and others. In addition, an oil-supplying passage (not shown) communicated with a main oil gallery (not shown) is provided in the inside of the camshaft 1 and so on, in order to supply and circulate the oil (lubricating oil) to an engine valve system. The electromagnetic coil 20 is thus cooled. That is, the supply and circulation of the oil avoid a change of electrical resistance of the electromagnetic coil 20 caused by a temperature change (especially, change to high temperature) of the electromagnetic coil 20 due to a braking operation by the hysteresis brake 17. And therefore, the strength of the braking force can be kept at a constant strength. Further, this can enhance lubricity of sliding portions such as the spiral guide groove 15 and the engaging pin 11.

Figure 4:
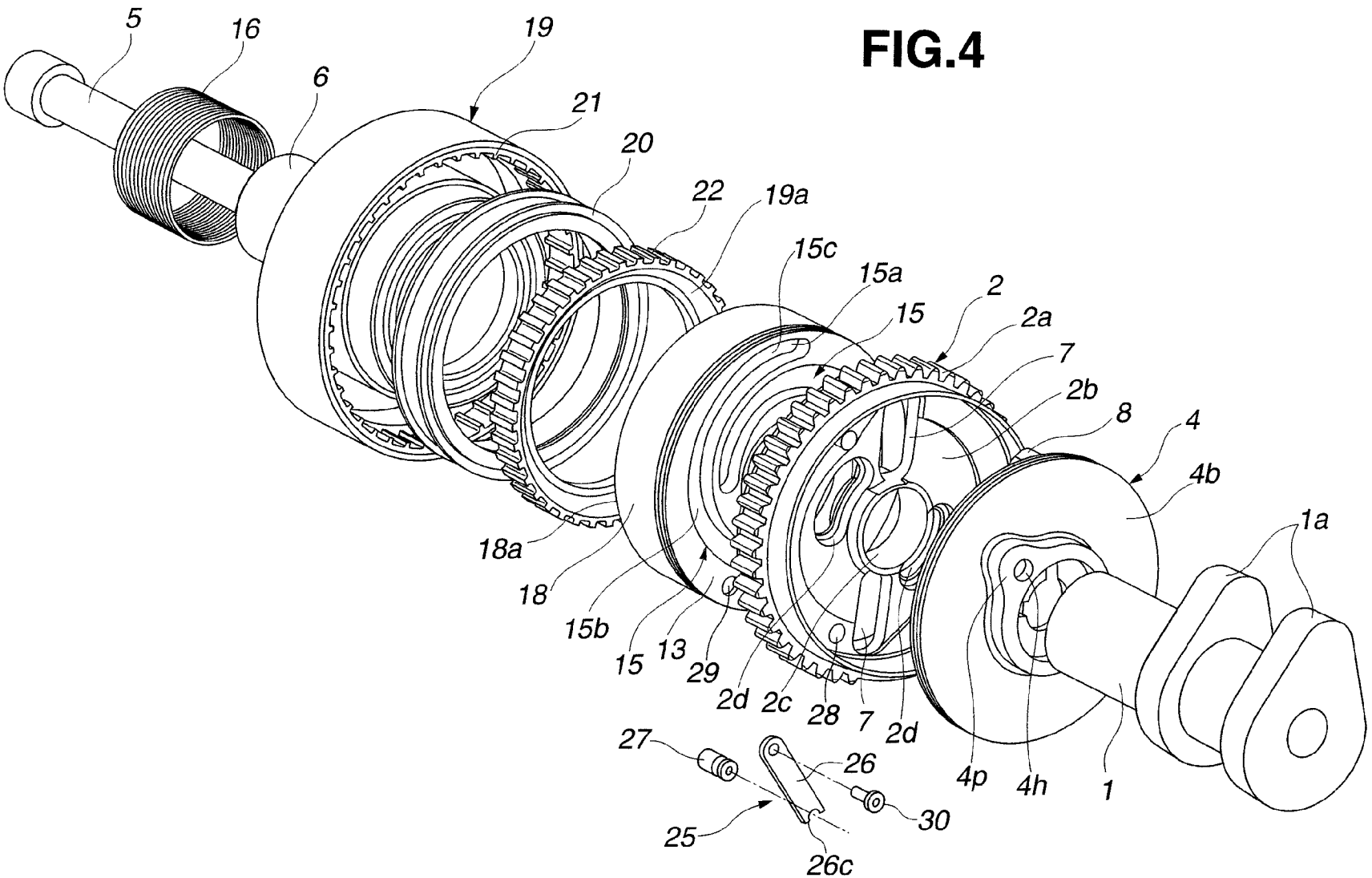
FIG. 4 is a perspective exploded view of the variable valve timing control apparatus, when viewed from a direction of the rear side.
Figure 5:
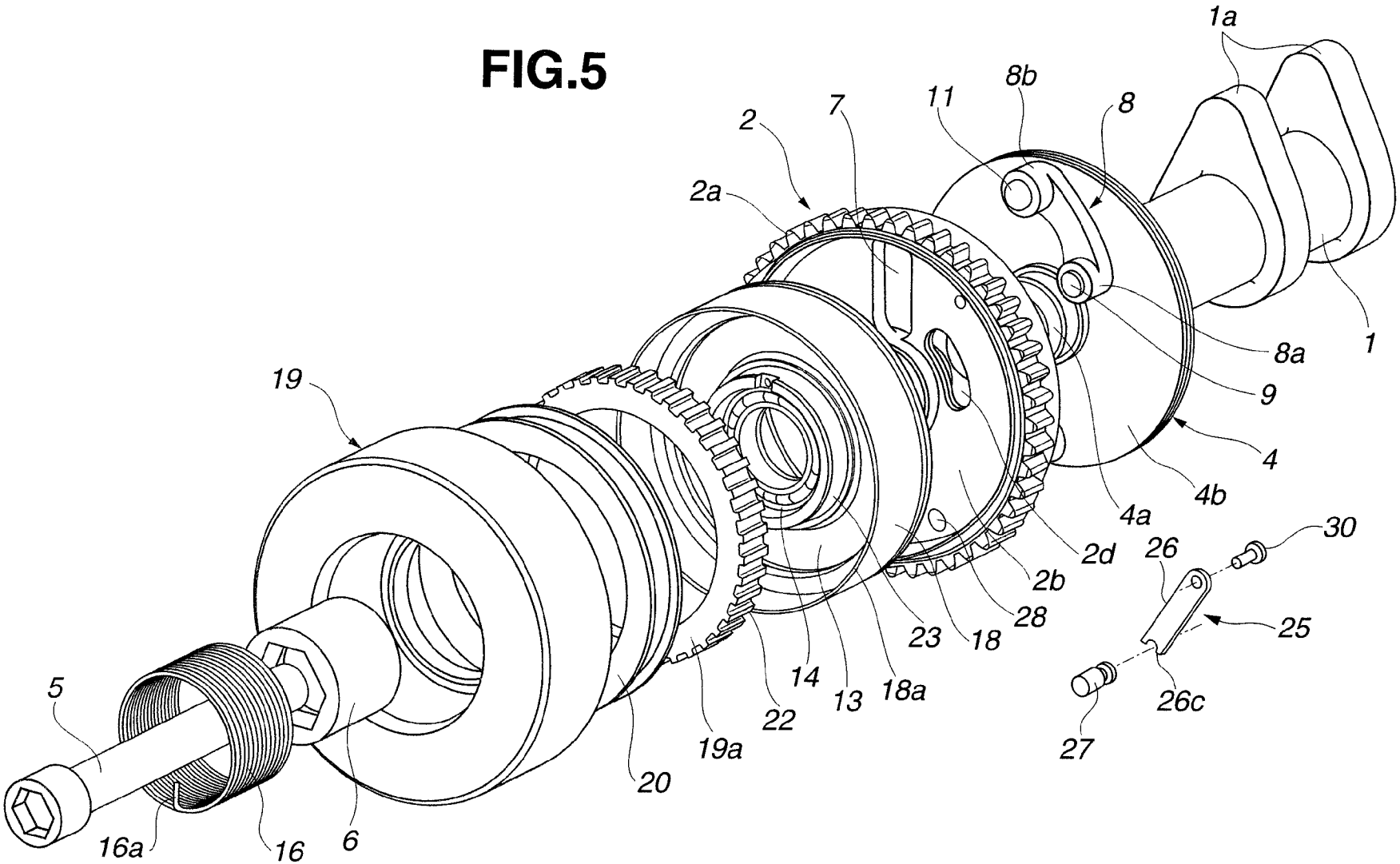
FIG. 5 is a perspective exploded view of the variable valve timing control apparatus, when viewed from a direction of the front side.
Figure 6:
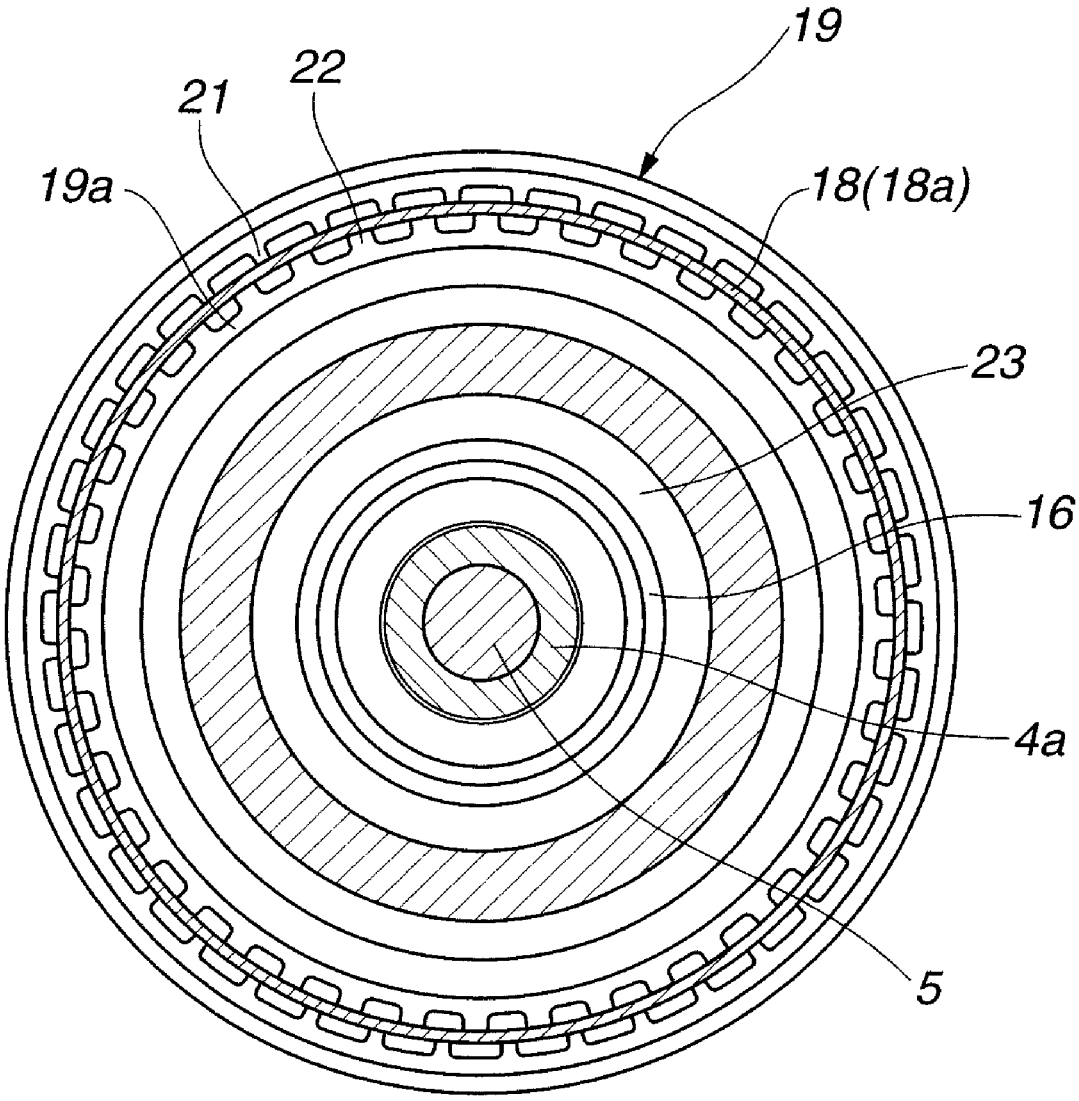
FIG. 6 is a sectional view of the variable valve timing control apparatus, when taken along a line A-A of FIG. 3.

As shown in FIGS. 3 to 5, in the variable valve timing control apparatus, a locking mechanism 25 is provided between the plate member 2*b* of the timing sprocket 2 and the spiral guide disk 13. The locking mechanism 25 serves to link or connect (or couple) the timing sprocket 2 and the spiral guide disk 13 and/or to release or disconnect them (release the linkage between the timing sprocket 2 and the spiral guide disk 13) in accordance with temperature of the oil supplied in the relative angular phase control mechanism 3 (in accordance with lubricating oil temperature of the engine).

This locking mechanism 25 has, as seen in FIGS. 1 to 5 and 7, a bimetal 26 (a movement adjustment part) that is a thermo-sensitive element and provided at a side of the plate member 2*b*, a lock pin 27 provided at one end of the bimetal 26 which is a free end, and a connecting hole 29 formed at a position on an outer surface of the disk portion 13*b* of the spiral guide disk 13, which corresponds to a position of the lock pin 27. In more detail, the connecting hole 29 is formed such that the lock pin 27 can be inserted into and extracted from the connecting hole 29 via a guide hole 28 formed at the plate member 2*b*.

The bimetal 26 is formed by coupling or bonding two long thin metal sheets or plates together, both of which bends down or curve together in a same direction in response to temperature change. For example, as seen in FIG. 1, a right-hand side metal plate is formed of a brass plate 26*a*, and a left-hand side metal plate is formed of an invar plate 26*b*. Furthermore, a fixed portion 30 is attached to an outer surface of the plate member 2*b* on a side of the camshaft 1, the other end of the bimetal 26 which is a fixed end is then fixed or secured to the fixed portion 30 substantially horizontally to the fixed portion 30. When an ambient oil temperature becomes substantially lower than or equal to 10° C., the bimetal 26 starts being deformed (starts bending down) and bends down curvedly in a direction of the disk portion 13*b*.

As for the lock pin 27, it is formed into a substantially cylindrical shape. A small diameter neck portion 27*a* is formed at one end of the lock pin 27, and an almost U-shaped connecting portion (or a stopper portion) 26*c* formed at the one end of the bimetal 26 is connected or fixed to the neck portion 27*a*. Further, in order to ensure an easy insertion and extraction of a top end portion 27*b* of the lock pin 27 into and from the connecting hole 29, an air vent hole 31*h* penetrates the lock pin 27 in an axial direction of the lock pin 27.

The guide hole 28 is formed so that an internal diameter of the guide hole 28 is uniformly formed and also is set to be slightly greater than an outer diameter of the lock pin 27 so as to guide the lock pin 27 into the connecting hole 29 smoothly along the axial direction with axes of both of the lock pin 27 and the connecting hole 29 fitted with each other.

With respect to the connecting hole 29, its internal diameter is formed to be slightly greater than an outer diameter of the top end portion 27*b* of the lock pin 27. Further, concerning the position where the connecting hole 29 is formed at the disk portion 13*b*, it is set such that both positions of the connecting hole 29 and the top end portion 27*b* are fitted with each other (namely that the top end portion 27*b* can be inserted into the connecting hole 29) under the condition where the engaging pin 11 is positioned at the top end portion of the outermost groove section 15*a* of the spiral guide groove 15.

In the following, operation of the variable valve timing control apparatus and working of the locking mechanism 25 will be explained.

In the engine stop state, by de-energizing the electromagnetic coil 20 of the hysteresis brake 17, the spiral guide disk 13 is rotated fully in the rotational direction of the engine with respect to the timing sprocket 2 by way of the force of the torsion spring 16. At this time, as shown in FIG. 7, the spherical-shaped end 11*a* of the engaging pin 11 is shifted and positioned at the top end portion of the outermost groove section 15*a* of the spiral guide groove 15, and therefore the rotational phase of the camshaft 1 relative to the engine crankshaft is shifted to the engine start-up phase, which is a slightly advanced phase position as compared with the most-retarded phase position, and is maintained at this position. That is to say, engine valve open and closure timings at the engine start-up are set to suitable timings for the engine start-up. As described above, after the engine stops, both positions of the lock pin 27 of the locking mechanism 25 and the connecting hole 29 of the disk portion 13*b* are aligned in the axial direction.

Under the engine stop state, the lubricating oil supplied in the relative angular phase control mechanism 3 does not circulate but remains in infinitesimal gaps or spaces between the hysteresis ring 18 and the pole teeth 21, 22. And viscous resistance of this oil becomes great. Particularly in cold climates or in the cold season such as winter, in the case where the engine stops for a long time and the lubricating oil temperature of the engine (i.e. the temperature of oil in the relative angular phase control mechanism 3) becomes substantially lower than or equal to 10° C. for example, the viscosity of the oil becomes further high and then the viscous resistance becomes greater. As a result, at the engine start-up, braking force occurs and acts on the hysteresis ring 18, there is thus a risk that the spiral guide disk 13 will be unintentionally turned to the advanced phase direction. A suitably set rotational phase for the engine start-up therefore becomes unstable.

Figure 2A:
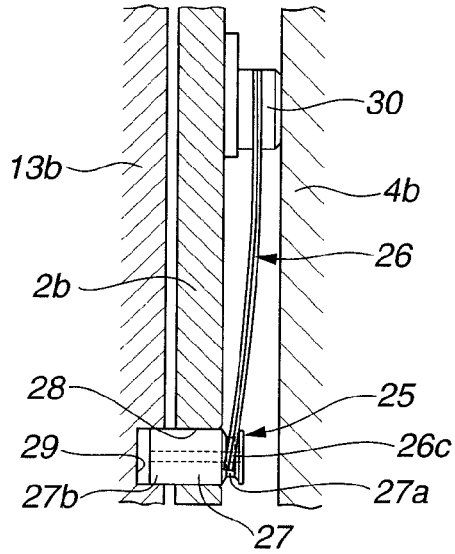
FIGS. 2A to 2C are diagrams to explain workings of locking mechanism according to the present invention.

Accordingly, in the embodiment, when the temperature of oil in the relative angular phase control mechanism 3 becomes substantially lower than or equal to 10° C., as shown in FIGS. 1 and 2A, a top end side (the one end) of the bimetal 26 of the locking mechanism 25 bends down to the side of the spiral guide disk 13. By this bending deformation, the lock pin 27 (the top end portion 27*b*) is inserted into the connecting hole 29 while sliding in the guide hole 28, then the plate member 2*b* (the timing sprocket 2) and the spiral guide disk 13 are connected with each other. It is therefore possible to certainly restrain a free rotation (the unintentional turn to the advanced phase direction) of the spiral guide disk 13 with respect to the plate member 2*b*.

When turning an ignition on for the engine starting afterwards, locking state between the timing sprocket 2 and the spiral guide disk 13 is kept or maintained by the locking mechanism 25, and the engaging pin 11 is maintained at the outermost groove section 15*a* with stability. Consequently, during the engine start-up period, the improper action of the relative angular phase control mechanism 3, caused by viscous resistance of the lubricating oil, namely the undesirable and unintentional free rotation of the spiral guide disk 13, can be restrained.

As described above, since the rotational phase is suitably maintained with stability at the engine start-up, the good engine startability can be ensured and also the deterioration of exhaust emission performance can be prevented.

After the engine starts, when an engine operating condition shifts to a low-rpm condition such as idling conditions, by the control current output to the electromagnetic coil 20 by the controller 24, the magnetic force is generated at the hysteresis brake 17 and the braking force against the force of the torsion spring 16 is provided to the spiral guide disk 13.

Figure 2B:
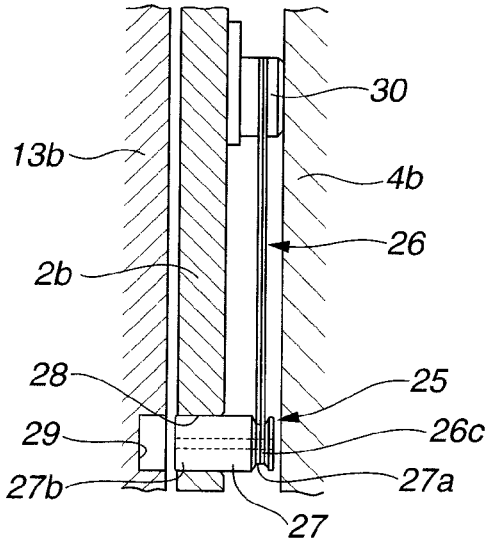

At this time, when the oil temperature becomes substantially higher than or equal to 10° C. by the warm-up of the engine, as shown in FIG. 2B, the bimetal 26 returns to an original linear shape. The top end portion 27*b* of the lock pin 27 is then extracted from the connecting hole 29, and further retreats to or pulled back to the guide hole 28. With this, the guided engaging pin 11 rapidly moves from a side of the top end 15*d* toward the inflexion point 15*c*.

Accordingly, the spiral guide disk 13 slightly rotates relatively in the reverse direction to the rotation of the timing sprocket 2. By this relative rotation, the engaging pin 11 (also the top end portion 8*b*) of the link member 8 moves in the radially outward direction in and along the radial direction guide window 7 while being guided by the spiral guide groove 15. Thus, a rotational phase of the driven rotary member 4 relative to the timing sprocket 2 is shifted toward the most-retarded phase position via the motion-conversion mechanism or working of the link member 8.

As a result, the rotational phase of the camshaft 1 relative to the engine crankshaft (i.e. the rotational phase between the camshaft 1 and the engine crankshaft) is shifted to a desired phase according to the engine operating condition. For instance, it is the retarded phase position or the most-retarded phase position suitable for the low-rpm conditions. This can therefore improve not only the stability of rotation of the engine but also fuel economy at the idling condition.

After this condition, during the engine operating at high-rpm under a normal driving condition, in order to shift the rotational phase toward the most-advanced phase position, further larger control current is supplied to the electromagnetic coil 20 by the controller 24. When the hysteresis ring 18 of the spiral guide disk 13 receives the braking force by the above control current, the spiral guide disk 13 relatively rotates further in the reverse direction to the rotation of the timing sprocket 2. And therefore, the engaging pin 11 is guided by the spiral guide groove 15 and moves toward an innermost portion of the normal section 15*b*, and also the top end portion 8*b* moves in the radially inward direction in and along the radial direction guide window 7. Thus, the rotational phase of the driven rotary member 4 relative to the timing sprocket 2 is shifted toward the most-advanced phase position by the motion-conversion mechanism or working of the link member 8. As a result, the rotational phase of the camshaft 1 relative to the engine crankshaft is shifted toward the most-advanced phase position. This can bring about a high power generation of the engine.

Figure 2C:
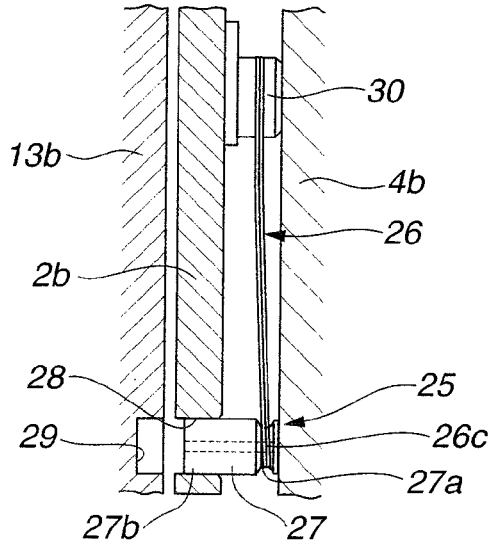

At this time, as seen in FIG. 2C, the lock pin 27 further retreats to or is pulled back to the guide hole 28 with an oil temperature increase. That is, the top end portion 27*b* of the lock pin 27 is positioned inside the guide hole 28. In this state, since the connecting hole 29 and the top end portion 27*b* are spaced apart from each other at a sufficient distance, an unintentional connection between the connecting hole 29 and the lock pin 27 (between the disk portion 13*b* and the plate member 2*b*) does not occur.

Figure 8:
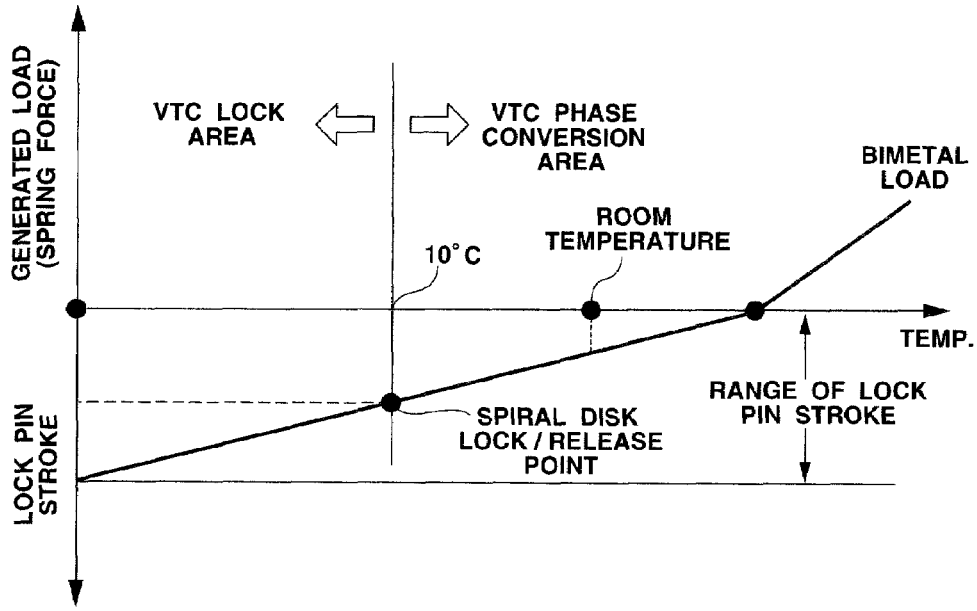
FIG. 8 is a diagram showing stroke characteristics of lock pin of the locking mechanism according to the first embodiment.

FIG. 8 illustrates a relationship between the oil temperature and the deformation of the bimetal 26 of the locking mechanism 25. When the oil temperature becomes substantially lower than or equal to 10° C., the bimetal 26 becomes deformed (bends down) to the side of the spiral guide disk 13. The top end portion 27*b* of the lock pin 27 is therefore inserted into the connecting hole 29, and the plate member 2*b* and the disk portion 13*b* of the spiral guide disk 13 are connected. That is, the variable valve timing control mechanism (VTC) is locked. On the other hand, when the oil temperature becomes substantially higher than or equal to 10° C., the bimetal 26 becomes deformed (bends down) in a direction opposite to the spiral guide disk 13. Needless to say, the lock pin 27 is extracted from the connecting hole 29, and the lock of the VTC is released.

As explained above, in this embodiment, the engine startability and the exhaust emission performance can be improved. In addition, the lock and unlock of the VTC are achieved by only the deformation (the bend) of the bimetal 26. Hence, a configuration of the locking mechanism 25 can be simplified, deterioration of operating efficiency of manufacturing or assembling can therefore be suppressed.

Moreover, by the locking operation or action by means of the locking mechanism 25 at the engine start-up, for example, even when disturbance such as an alternate torque arises and is transferred to the link member 8 or the spiral guide disk 13, the unintentional free rotation of the spiral guide disk 13 can be prevented.

Figure 9:
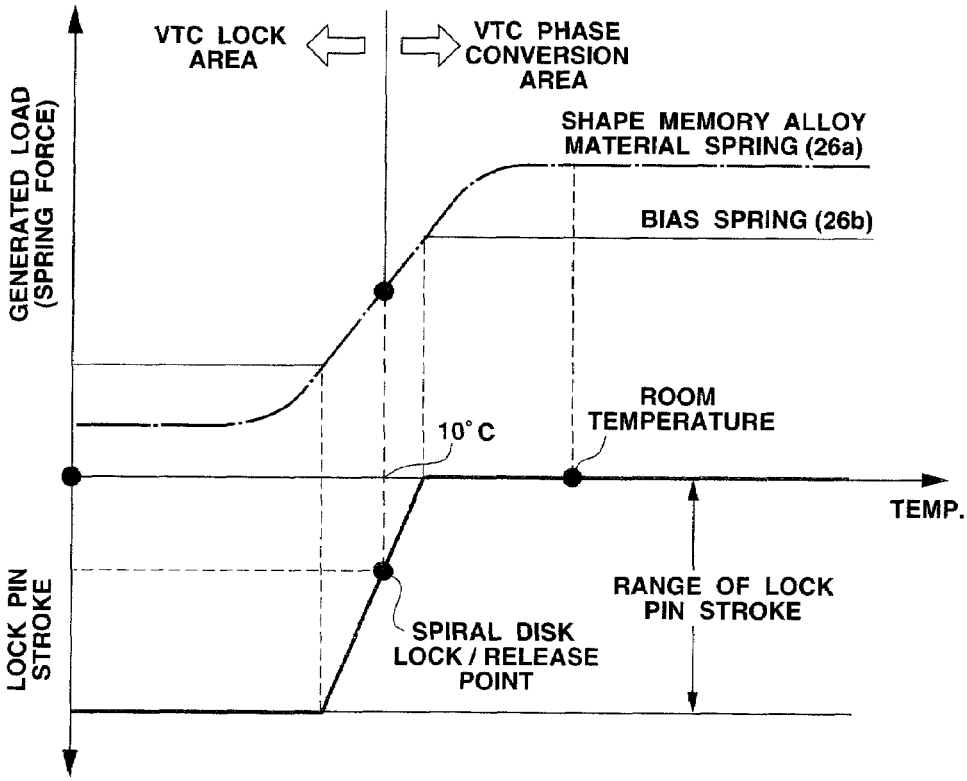
FIG. 9 is a diagram showing stroke characteristics of the lock pin of the locking mechanism according to the second embodiment.

FIG. 9 illustrates characteristics of an amount of bending deformation and an oil temperature of a case where the configuration or structure of the bimetal 26 is changed, as a second embodiment of the present invention. In this embodiment, the bimetal 26 is formed by coupling or bonding two metal sheets or plates; a shape memory alloy spring 26*a* at the side of the spiral guide disk 13 and a bias spring 26*b* that keeps rectilinearity.

As can be seen in FIG. 9, the shape memory alloy spring 26*a* is curvedly deformed (bends down) with the oil temperature of almost 10° C. being a border. When the oil temperature becomes substantially lower than or equal to 10° C., the shape memory alloy spring 26*a* is deformed by a balance of spring forces (loads) between the shape memory alloy spring 26*a* and the bias spring 26*b*, and the lock pin 27 is inserted into the connecting hole 29.

More specifically, for example, when the oil temperature is room temperature such as about 20° C., the spring force (the spring load) of the shape memory alloy spring 26*a* is greater as compared with that of the bias spring 26*b*. Under this condition, the lock pin 27 is pushed onto a side surface of the large-diameter stepped flange portion 4*b* of the driven rotary member 4. The lock pin 27 is not being inserted into the connecting hole 29 in this condition, and the relative rotation between the camshaft 1 and the timing sprocket 2 is allowed.

When the oil temperature lowers from the room temperature after the engine stops, the spring force of the shape memory alloy spring 26*a* is constant for a while and starts decreasing rapidly with a further temperature decrease. After that, the lock pin 27 starts moving toward the spiral guide disk 13 from a point when the spring force of the shape memory alloy spring 26*a* balances with that of the bias spring 26*b*. Further, at nearly 10° C., the lock pin 27 starts being inserted into the connecting hole 29, and therefore the rotation of the spiral guide disk 13 relative to the timing sprocket 2 is limited. That is, an operation or action of the relative angular phase control mechanism 3 becomes impossible (the relative angular phase control mechanism 3 is locked), and the relative rotational phase is kept constant without being affected by a drag torque due to the oil viscous resistance (oil viscous drag).

The lock pin 27 is further inserted into the connecting hole 29 until the top end portion 27*b* strikes a bottom face of the connecting hole 29 afterward. After the top end portion 27*b* strikes the bottom face of the connecting hole 29, the spring force of the shape memory alloy spring 26*a* continues decreasing, and becomes less than the spring force of the bias spring 26*b*. After a while, the spring force of the shape memory alloy spring 26*a* becomes substantially constant.

On the other hand, when the oil temperature increases from less than 10° C., the spring force of the shape memory alloy spring 26*a* is constant for a while and starts increasing rapidly with a further temperature increase. After that, the lock pin 27 starts moving toward the large-diameter stepped flange portion 4*b* from the point when the spring force of the shape memory alloy spring 26*a* balances with that of the bias spring 26*b*. Further, at nearly 10° C., the lock pin 27 is extracted from the connecting hole 29, and therefore the operation or action of the relative angular phase control mechanism 3 becomes possible. That is, the relative rotation between the camshaft 1 and the timing sprocket 2 is allowed (the lock of the relative angular phase control mechanism 3 is released).

The lock pin 27 further moves toward the large-diameter stepped flange portion 4*b* until the lock pin 27 strikes the large-diameter stepped flange portion 4*b*. After the lock pin 27 strikes the large-diameter stepped flange portion 4*b*, the spring force of the shape memory alloy spring 26*a* continues increasing, and becomes greater than the spring force of the bias spring 26*b*. After a while, the spring force of the shape memory alloy spring 26*a* becomes substantially constant.

In the second embodiment, by an effect specific to the shape memory alloy, a stroke change amount (a change amount of movement of the lock pin 27) with respect to the temperature change becomes greater than the bimetal 26 of the first embodiment. Thus, variations in the lock and unlock of the VTC can be suppressed.

Figure 10:
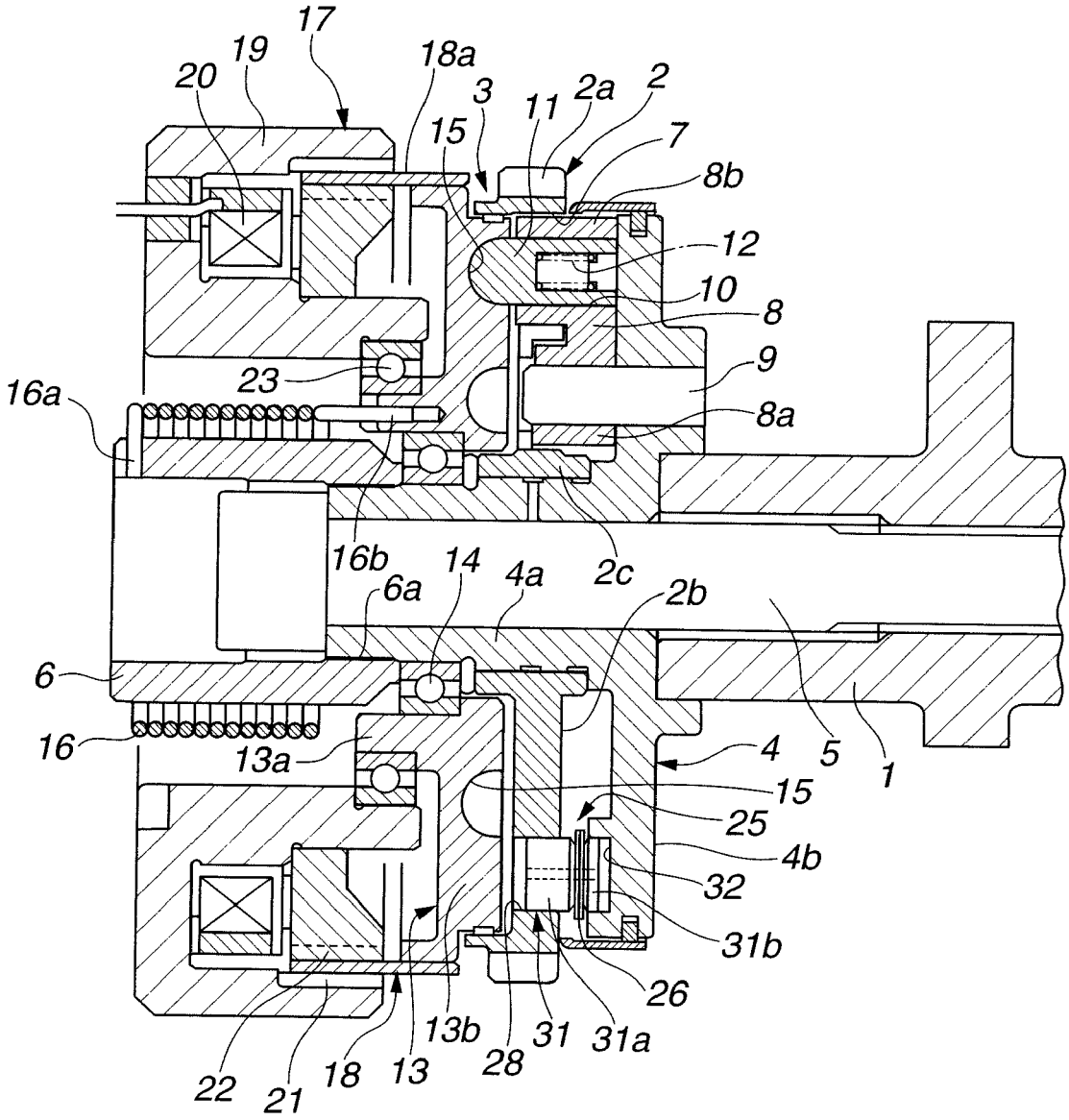
FIG. 10 is a longitudinal cross section of a variable valve timing control apparatus according to the third embodiment.
Figure 11:
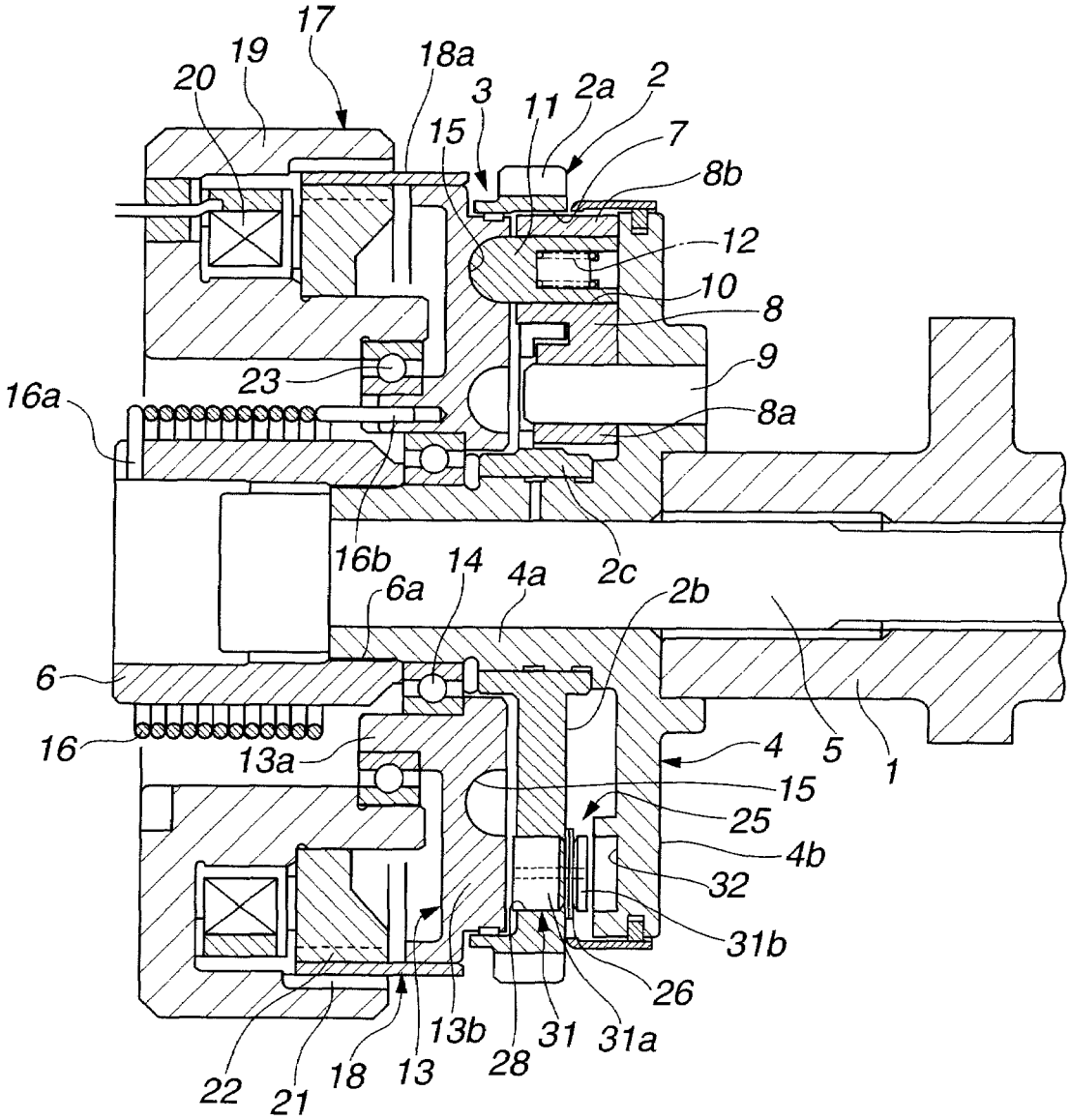
FIG. 11 is a longitudinal cross section of a variable valve timing control apparatus according to the third embodiment, to explain workings of the locking mechanism.

FIGS. 10 and 11 illustrate a third embodiment. In the third embodiment, the locking mechanism 25 is provided between the plate member 2*b* and the large-diameter stepped flange portion 4*b* of the driven rotary member 4. That is, a lock pin 31, which protrudes in front and rear directions, is fixed to the top end of the bimetal 26. And also a connecting hole 32 is formed at a position on the large-diameter stepped flange portion 4*b*, which corresponds to a position of the lock pin 31.

With respect to the lock pin 31, it is formed such that one end portion 31*a* of the lock pin 31 is slidably supported by or disposed in the guide hole 28 formed at the plate member 2*b* and also an other end portion 31*b* of the lock pin 31 can be inserted into and extracted from the connecting hole 32.

Concerning the position where the connecting hole 32 is formed at the large-diameter stepped flange portion 4*b*, in the same manner as the first embodiment, it is set such that both positions of the connecting hole 32 and the other end portion 31*b* are fitted with each other (namely that the other end portion 31*b* can be inserted into the connecting hole 32) under the condition where the engaging pin 11 is positioned at the top end portion of the outermost groove section 15*a* of the spiral guide groove 15 (i.e. under the condition of the slightly advanced phase position from the most-retarded phase position).

The configuration or formation of the bimetal 26 is similar to the first embodiment. However, in this embodiment, the bimetal 26 is set such that when the oil temperature becomes substantially lower than or equal to 10° C., the bimetal 26 bends down or curves in a direction of the large-diameter stepped flange portion 4*b*, and also when the oil temperature becomes substantially higher than or equal to 10° C., the bimetal 26 bends down in a direction opposite to the large-diameter stepped flange portion 4*b*.

Accordingly, as described above, in the case where the engine stops for a long time and the temperature of oil in the relative angular phase control mechanism 3 becomes substantially lower than or equal to 10° C. in the cold season such as winter, as shown in FIG. 10, the bimetal 26 bends down toward the large-diameter stepped flange portion 4*b*, and the other end portion 31*b* of the lock pin 31 is inserted into the connecting hole 32 with the one end portion 31*a* sliding in the guide hole 28. By this insertion, the camshaft 1 and the timing sprocket 2 are connected with each other via the driven rotary member 4.

On the other hand, when the oil temperature becomes substantially higher than or equal to 10° C. after the engine start-up, as shown in FIG. 11, the bimetal 26 bends down to the opposite side, and the lock pin 31 slides toward the disk portion 13*b*. The other end portion 31*b* of the lock pin 31 is then extracted from the connecting hole 32, and the connection (the lock) between the camshaft 1 and the timing sprocket 2 is released. At this time, the lock pin 31 is set so that the lock pin 31 does not interfere with the rotation of the spiral guide disk 13. Hence, in this case as well, the same effects as the above embodiments are obtained.

Configuration or structure of the present invention is not limited to that of the above embodiments. For example, the bimetal could be formed by connecting or coupling materials which are deformed by temperature difference, other than the combination of the shape memory alloy material and the bias spring. Further, a deformation start temperature of the bimetal 26 can be set to a desired temperature such as 0° C. (less than 10° C.) or a temperature more than 10° C. Also, regarding the temperature, it is not to limited to the temperature of oil in the relative angular phase control mechanism 3. It might be possible that the thermo-sensitive element is deformed by detecting or sensing the temperature other than this oil temperature.

Furthermore, the locking mechanism 25 could be provided at any positions as long as the locking mechanism 25 is disposed between the camshaft 1 and the timing sprocket 2. For instance, it could be provided between the link member 8 and the timing sprocket 2, then these link member and the timing sprocket are linked (locked). Or the relative angular phase control mechanism 3 (the spiral guide disk 13, link member 8 etc.) and the driven rotary member 4 might be linked or connected to restrain the operation of the relative angular phase control mechanism 3. In the case of the connection of the link member 8 and the driven rotary member 4, the top end portion 8*b* of the link member 8 is fixed to the driven rotary member 4. Therefore the motion-conversion mechanism or working of the link member 8 are not allowed, and the operation of the relative angular phase control mechanism 3 is restrained.

Moreover, as the drive rotary member rotated by the engine crankshaft in synchronization with the engine crankshaft, a timing pulley driven by an elastic timing belt or a member driven by gear engagement other than the sprocket, could be possible.

In addition, instead of using the spiral guide disk with the spiral guide groove for the relative angular phase control mechanism, for instance, a cam with a cam groove or a cammed portion might be used. The cam is formed with the cam groove, and a piston hydraulically or electromagnetically actuated and moving in the axial direction is formed with a protrusion at the top thereof. The protrusion slides along the cam groove, and thus the relative rotational phase of the camshaft is adjusted in the same manner as the above mentioned embodiments. In this case as well, the relative rotational phase is changed depending on a shape of the cam groove. Further, instead of the electromagnetic brake, the relative angular phase control mechanism might have a helical gear type brake.

Further, as an unit or mechanism for forcing the spiral guide disk to turn in one direction, the following means can be possible instead of using the torsion spring. That is, the convergence rate of the spiral guide groove is set such that the spiral guide disk turns toward a rotational position suitable for the engine start-up by using torque difference between the positive and negative torque fluctuations occurring at camshaft as a power source.

With respect to the radial direction guide window, instead of this, a guiding projection or a guiding groove to slidably hold and guide the engaged portion could be used. In the case of the guiding projection, it can be arranged not only continuously but discontinuously. Further, radial direction guide window and the guiding groove could be formed curvilinearly other than linearly. However, these modified examples have to be set such that these extend from center of rotation to radially outward direction.

In the above embodiments, the spiral guide groove having a bottom is used. However, a spiral guide groove without a bottom, that is, spiral guide groove that penetrates the intermediate rotary member (the spiral guide disk 13) can be used. Moreover, the spiral guide groove may be formed by forming a protrusion. In addition, the movable member can be formed into any proper shape, and a roller or a ball can be provided at a top end portion of the movable member as a sliding member.

This application is based on a prior Japanese Patent Application No. 2006-191179 filed on Jul. 12, 2006. The entire contents of this Japanese Patent Application No. 2006-191179 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable valve timing control apparatus of an internal combustion engine, comprising:

a drive rotary member rotated by an engine crankshaft;

a driven rotary member fixed to a camshaft that has a cam opening/closing an engine valve, the driven rotary member driven by the drive rotary member;

a phase-change mechanism provided between the drive and driven rotary members and changing a relative rotational phase between the drive and driven rotary members; and a locking mechanism linking and releasing the link between any two of the drive rotary member, the driven rotary member and the phase-change mechanism in accordance with temperature of the phase-change mechanism.

2. The variable valve timing control apparatus as claimed in claim 1, wherein:

the phase-change mechanism has a spiral disk rotatably connected to the camshaft and a link member movably connected with the drive rotary member, and the locking mechanism links and releases the link between either one of the spiral disk or the link member and either one of the drive rotary member or the driven rotary member.

3. The variable valve timing control apparatus as claimed in claim 2, wherein:

the locking mechanism links and releases the link between the spiral disk and the drive rotary member.

4. The variable valve timing control apparatus as claimed in claim 2, wherein:

the locking mechanism links and releases the link between the link member and the drive rotary member.

5. The variable valve timing control apparatus as claimed in claim 2, wherein:

the locking mechanism links and releases the link between either one of the link member or the drive rotary member and the camshaft.

6. A variable valve timing control apparatus of an internal combustion engine, comprising:

a drive rotary member rotated by an engine crankshaft;

a driven rotary member fixed to a camshaft that has a cam opening/closing an engine valve, the driven rotary member driven by the drive rotary member;

a phase-change mechanism provided between the drive and driven rotary members and changing a relative rotational phase between the drive and driven rotary members;

a locking mechanism linking and releasing the link between any two of the drive rotary member, the driven rotary member and the phase-change mechanism in accordance with temperature of the phase-change mechanism, and the locking mechanism having a lock pin establishing the link and releasing the link, a connecting hole into which the lock pin is inserted, and a movement adjustment part moving the lock pin in a direction in which the lock pin is inserted into the connecting hole when the temperature of the phase-change mechanism becomes substantially lower than or equal to a predetermined temperature and also moving the lock pin in a direction in which the lock pin is extracted from the connecting hole when the temperature of the phase-change mechanism becomes substantially higher than or equal to the predetermined temperature.

7. The variable valve timing control apparatus as claimed in claim 6, wherein:

the locking mechanism has a thermo-sensitive element that adjusts the movement of the lock pin.

8. The variable valve timing control apparatus as claimed in claim 7, wherein:

the thermo-sensitive element is formed by a bimetal whose one end is a fixed end and whose other end is connected with the lock pin.

9. The variable valve timing control apparatus as claimed in claim 8, wherein:

the bimetal is bonded thin metal plates of a shape memory alloy material and a bias spring material.

10. The variable valve timing control apparatus as claimed in claim 6, wherein:

the lock pin of the locking mechanism is provided at any one of the drive rotary member, the driven rotary member and the phase-change mechanism, and the connecting hole is formed at one of the rest of the drive rotary member, the driven rotary member and the phase-change mechanism.

11. A variable valve timing control apparatus of an internal combustion engine, comprising:

a drive rotary member rotated by an engine crankshaft;

a driven rotary member fixed to a camshaft that has a cam opening/closing an engine valve, the driven rotary member driven by the drive rotary member;

a phase-change mechanism provided between the drive and driven rotary members and changing a relative rotational phase between the drive and driven rotary members; and in a case where temperature of the phase-change mechanism is substantially lower than or equal to a predetermined temperature, any two of the drive rotary member, the driven rotary member and the phase-change mechanism being connected with each other and rotation of the camshaft relative to the engine crankshaft being restrained.

* * * * *